US005344245A

United States Patent [19]

Tajima et al.

[11] Patent Number: 5,344,245

[45] Date of Patent: Sep. 6, 1994

[54] SERIAL PRINTER

[75] Inventors: Akio Tajima; Hiroyuki Harada; Harukazu Shimizu; Haruo Inoue, all of Tokyo; Takashi Kougo, Chiba; Hajime Oda, Chiba; Tadashi Nakagawa, Chiba; Tsuyoshi Hayakawa, Chiba, all of Japan

[73] Assignee: Seikosha Co., Ltd., Tokyo, Japan

[21] Appl. No.: 912,459

[22] Filed: Jul. 13, 1992

Related U.S. Application Data

[63] Continuation-in-part of Ser. No. 702,554, May 20, 1991, abandoned, and a continuation-in-part of Ser. No. 742,117, Aug. 8, 1991, abandoned.

[30] Foreign Application Priority Data

| | | | |
|---|---|---|---|
| May 23, 1990 | [JP] | Japan | 2-133188 |
| Aug. 10, 1990 | [JP] | Japan | 2-213080 |
| Nov. 30, 1990 | [JP] | Japan | 2-337297 |

[51] Int. Cl.[5] ..... B41J 25/304

[52] U.S. Cl. ..... 400/320; 400/352; 400/354

[58] Field of Search ..... 400/23, 24, 88, 120, 400/120 HE, 352, 354, 690.4, 693, 320; 346/145; 101/53, 57

[56] References Cited

U.S. PATENT DOCUMENTS

| | | | |
|---|---|---|---|
| 4,189,244 | 2/1980 | Harrison | 400/320 |
| 4,643,597 | 2/1987 | Matsui et al. | 400/320 |
| 4,643,602 | 2/1987 | Ikeda et al. | 400/320 |
| 4,909,645 | 3/1990 | Sudo et al. | 400/120 |
| 4,934,847 | 6/1990 | Shiozaki et al. | 400/120 |
| 4,995,745 | 2/1991 | Yokoi et al. | 400/625 |
| 5,005,026 | 4/1991 | Sakai | 400/120 |
| 5,085,533 | 2/1992 | Kitahara et al. | 400/652 |
| 5,087,926 | 2/1992 | Wakui | 400/120 |

FOREIGN PATENT DOCUMENTS

| | | |
|---|---|---|
| 0124973 | 6/1987 | Japan . |
| 0199669 | 8/1988 | Japan . |

*Primary Examiner*—Edgar S. Burr
*Assistant Examiner*—John S. Hilten
*Attorney, Agent, or Firm*—Jordan and Hamburg

[57] ABSTRACT

A serial printer comprises a printing head, a carrier for carrying the printing head, a platen, and a pair of guide members extending in parallel with the platen for supporting the carrier in a movable manner. An openable member is attached openably to the casing of the printer and supporting one of the guide members. Engaging receivers are formed in the carrier for allowing the one guide member to engage therewith and disengage therefrom in a direction substantially perpendicular to the extending direction of the one guide member. Engaging brackets may be mounted on the printing head for coming into and out of engagement with one of the guide members at a right angle with respect to the extending direction of the one guide member. Moving members may be supported movably in the casing of the printer for supporting the one guide member, when moved, to bring the one guide member into and out of an engagement with the engaging brackets. One of the pair of guide members can be supported by a front cover which can open and close a printer case. Because of the above described construction, the printing head guide can be made compact in size, light in weight and inexpensive to manufacture.

19 Claims, 14 Drawing Sheets

SERIAL PRINTER

RELATED APPLICATIONS

This is a continuation-in-part application of U.S. Ser. No. 07/702,554, filed May 20, 1991, now abandoned, and also a continuation-in-part application of U.S. Ser. No. 07/742,117, filed Aug. 8, 1991 now abandoned.

FIELD OF THE INVENTION

The present invention relates to a serial printer of the type in which a printing head is carried at a right angle with respect to a paper feeding direction. The present invention also relates to a printing head guide device for a dot printer and more particularly a printing head guide device for guiding a printing head along a pair of parallel shafts.

BACKGROUND OF THE INVENTION

The serial printer has its printing head moved at a right angle with respect to the paper feeding direction.

FIG. 9 shows a structure of the printer of this kind according to the prior art. As shown, a carrier 61 carrying a printing head 60 is supported to move at a right angle with respect to the paper feeding direction (i.e., normal to the surface of the sheet of FIG. 9) by means of a pair of guide pins 63 and 64 which extend in parallel with a platen 62. For the printing operation, the printer is so charged with an ink ribbon cassette 65 that an ink ribbon 66 may be threaded between the nose portion 60*a* of the printing head 60 and the platen 62.

With this structure, however, the printing head 60 cannot be adjusted back and forth with respect to the platen 62, thus causing inconvenience. For example, the clearance between the nose portion 60*a* of the printing head 60 and the platen 62 is so small (e.g., usually 0.2 to 0.3 mm) that the ink ribbon 66 is hard to thread through the clearance when the printer is charged with the ink ribbon cassette 65. When the printer is to be set with (not shown) sheets of recording paper, they are inconveniently hard to thread between the nose portion 60*a* of the printing head 60 and the platen 62.

In a conventional printing head reciprocation mechanism of a serial type dot printer, a carriage is slidably supported by a pair of parallel guide rods and a printing head is securely mounted on a carriage. The carriage is moved along the pair of parallel guide rods by a timing belt or the like so that the printing head is reciprocably moved.

As a result, a large carriage which is slidably fitted on a pair of guide rods is needed so that there arises the problem that a printing head guide device becomes large in size.

SUMMARY OF THE INVENTION

In view of the background thus far described, therefore, the present invention has an object to provide a serial printer which is enabled to eliminate the above-specified disadvantages by making it possible to move the printing head, if necessary, apart from the platen.

In a serial printer according to the present invention, an openable member is attached openably to the casing of the printer and supports one of the guide members, and engaging receivers are formed in the carrier for allowing the one guide member to engage therewith and disengage therefrom in a direction substantially perpendicular to the extending direction of the one guide member.

Preferably, a printer frame may be positioned in the printer casing and formed with a U-shaped positioning groove for positioning the one guide member with respect to the printer frame when the one guide member is engaged with the positioning groove.

Preferably, the openable member is a printer cover.

In another serial printer according to the present invention, engaging brackets are mounted on the printing head for coming into and out of engagement with one of the guide members at a right angle with respect to the extending direction of the one guide member, and moving members are supported movably in the casing of the printer for supporting the one guide member, when moved, to bring the one guide member into and out of engagement with the engaging brackets.

The engaging brackets are formed integrally with the printing head.

In order to facilitate and ensure the positioning of the one guide member, the moving members may be swingably supported by either the printer casing or a printer frame disposed in the printer casing. In order to facilitate and ensure the guide member positioning better, the printer frame may have a positioning groove for coming into engagement with the one guide member, when the one guide member is moved to the position for engagement with the one guide member when the one guide member is moved to the position for disengagement from the engaging brackets.

In order to automate the engagement and disengagement of the one guide member with and from the engaging brackets, an openable cover may be attached to the printer casing, and links may be interposed between the openable cover and the moving members for connecting the same two in an associated manner to bring the one guide member, when the openable cover is opened, into the position for disengagement from the engaging brackets, and, when the openable cover is closed, into the position for engagement with the engagement brackets.

According to the structures specified above, the one guide member is disengaged from the carrier when the openable member is opened. As a result, the carrier can be turned on the other guide member to move the printing head apart from the platen.

Moreover, the one guide member can be brought into and out of engagement with the engaging brackets of the printing head, when the moving members are displaced, so that the printing head can be turned on the other guide member, when the one guide member is disengaged from the engaging brackets, to move apart from the platen.

Another object of the present invention is to provide a printing head guide device which in turn makes a dot printer compact in size, light in weight, highly reliable and dependable in operation.

In order to attain the last-mentioned and other objects, in a printing head guide device for guiding a printing head along a pair of parallel guide rods, according to the present invention, at least one engaging means for slidably engaging with one of the pair of guide rods is attached to one side surface of the printing head.

At least one of the pair of guide rods guides the printing head through slidable engaging means formed integral with the printing head by molding or independent sliding means securely attached to the printing head.

As described above, one of the means for slidable engagement with one of the pair of guide rods is formed integral with or attached to one side surface of the printing head so that the means for slidable engagement with the pair of guide rods can be made compact in size. When at least one means for slidable engagement with one of the pair of the guide rods is formed integral with the printing head, the printing head guide device can be fabricated with a smaller number of components at less manufacturing costs.

The present invention will become more apparent from the following description of a preferred embodiment thereof taken in conjunction with the accompanying drawings.

BRIEF DESCRIPTION OF THE DRAWINGS

FIG. 1 is a cross-sectional view;

FIG. 2 is a sectional view taken along line X—X of FIG. 1;

FIG. 3 is a sectional view showing the open state of a printer cover;

FIG. 4 is a sectional view showing the same but partially omitting the internal mechanism;

DESCRIPTION OF THE PREFERRED EMBODIMENTS

FIGS. 1 to 4 show a serial printer 1 according to one embodiment of the present invention.

Figure 1:
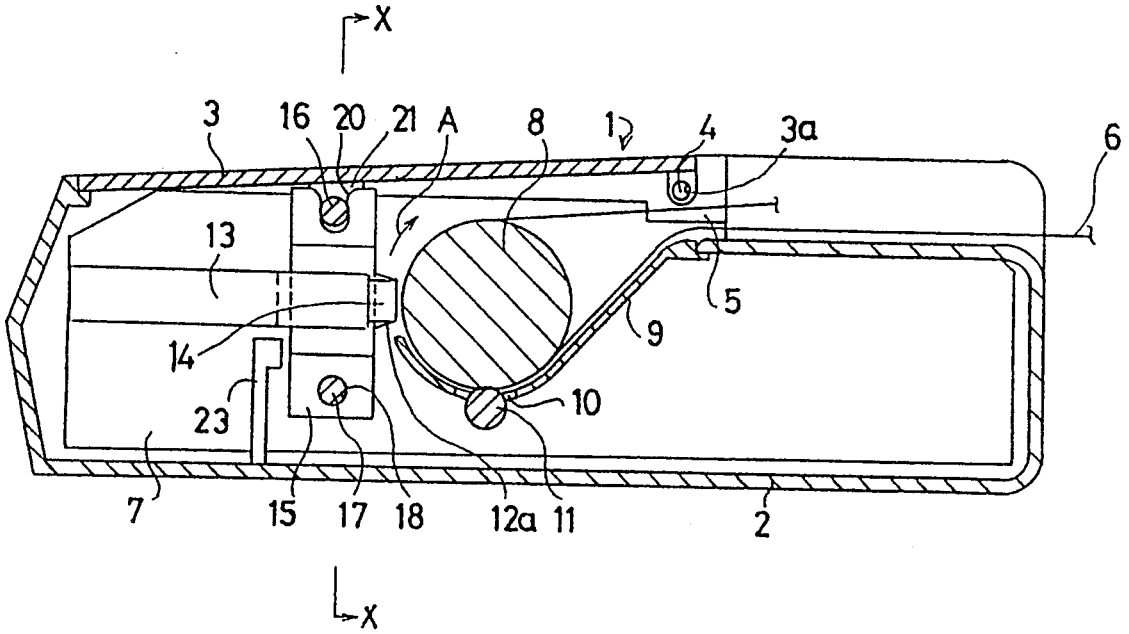
In FIGS. 1 to 4 showing a serial printer according to the present invention.

As shown in FIG. 1, a printer cover 3 is attached to the top portion of a box-shaped printer casing 2. The printer cover 3 is so hinged through a pin 4 to the two side portions of the printer casing 2 that it can be opened or closed, if necessary. Between the fulcrum side end portion of the printer cover 3 and the upper wall portion of the printer casing 2, there is formed an opening 5 through which a sheet of recording paper 6 is inserted and set in the printer casing 2 and is discharged to the outside of the printer casing 2 after it has been printed.

At the two sides in this printer casing 2, there is disposed a mechanism frame 7 by which a platen 8 is rotatably borne and to which a guide plate 9 is fixed for guiding the recording paper 6 from the opening 5 onto the outer circumference of the platen 8. The guide plate 9 is omitted from FIG. 4 so as to simplify the illustration.

The guide plate 9 is formed below the platen 8 with a through hole 10, through which a pinch roller 11 is arranged to face the platen 8. This pinch roller 11 can be brought into and out of contact with the platen 8 by the action of not-shown actuation means. When the recording paper 6 is to be set, the pinch roller 11 is brought apart from the platen 8 so that the recording paper 6 can be threaded between the pinch roller 11 and the platen 8. After the recording paper 6 has been set, on the other hand, the pinch roller 11 is elastically brought into contact with the platen 8 through the recording paper 6 so that it is clamped between the pinch roller 11 and the platen 8.

Figure 2:
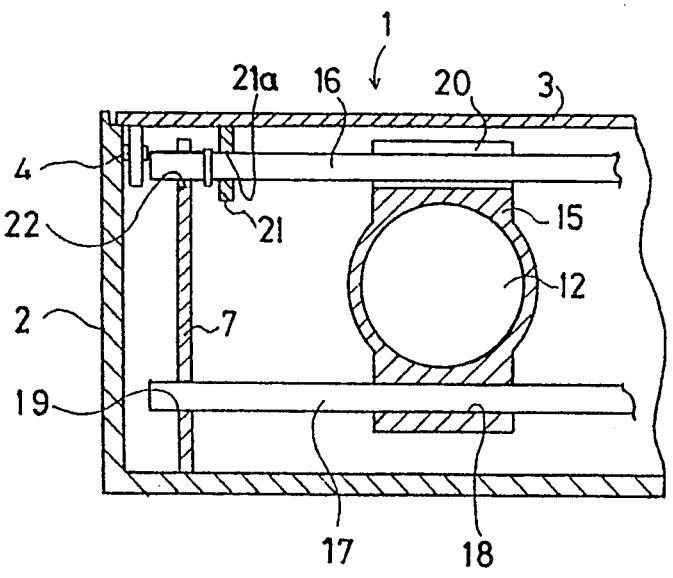

The platen 8 can be rotated in the direction of arrow A by the action of a not-shown drive means to impart a conveying force to the recording paper 6. This platen 8 is faced by a printing head 12 (as shown in FIG. 2) having a nose portion 12*a*. An ink ribbon cassette 13 has its ink ribbon 14 threaded between the nose portion 12*a* and the platen 8.

Figure 3:
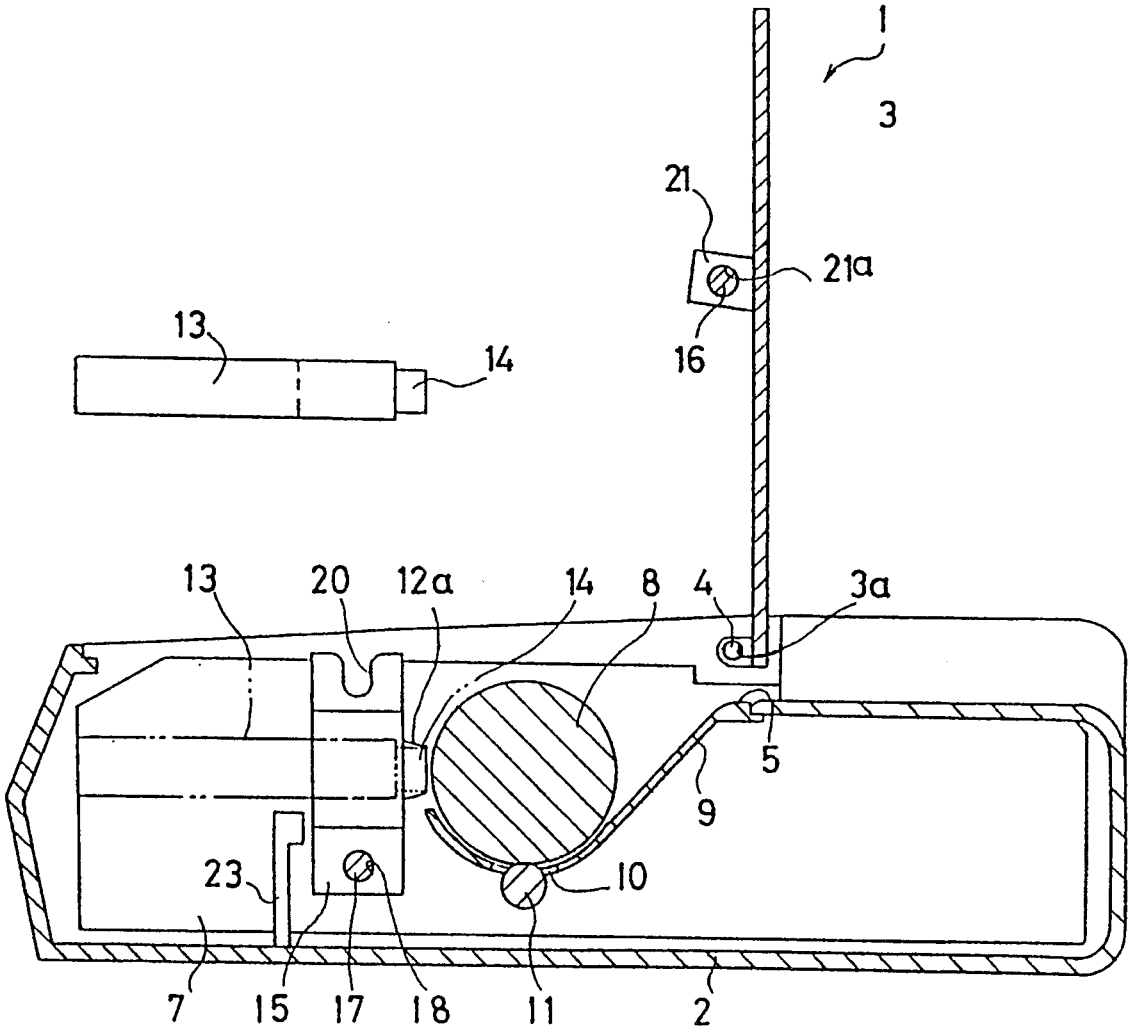

The ink ribbon cassette 13 is inserted, as shown in FIG. 3, from above the printer casing 2 with the printer cover 3 being opened. The ink ribbon cassette 13 in its charged state is held in the frame 7 by the action of not-shown support means.

The printing head 12 is carried by a carrier 15, as shown in FIG. 2, so that it can print the recording paper 6 while being moved together with the carrier 15 in parallel with the platen 8.

The carrier 15 itself has its upper and lower end portions supported, sa shown in FIG. 1, to move in parallel with the platen 8 by a pair of guide pins 16 and 17 which extend in parallel with the platen 8. This carrier 15 can be turned around the lower guide pin 17 when the printer cover 3 is opened.

More specifically, the guide pin 17 slidably extends through a hole 18, which is formed in the lower portion of the carrier 15, and is fixedly held in mounting holes 19 of the frame 7.

Figure 4:
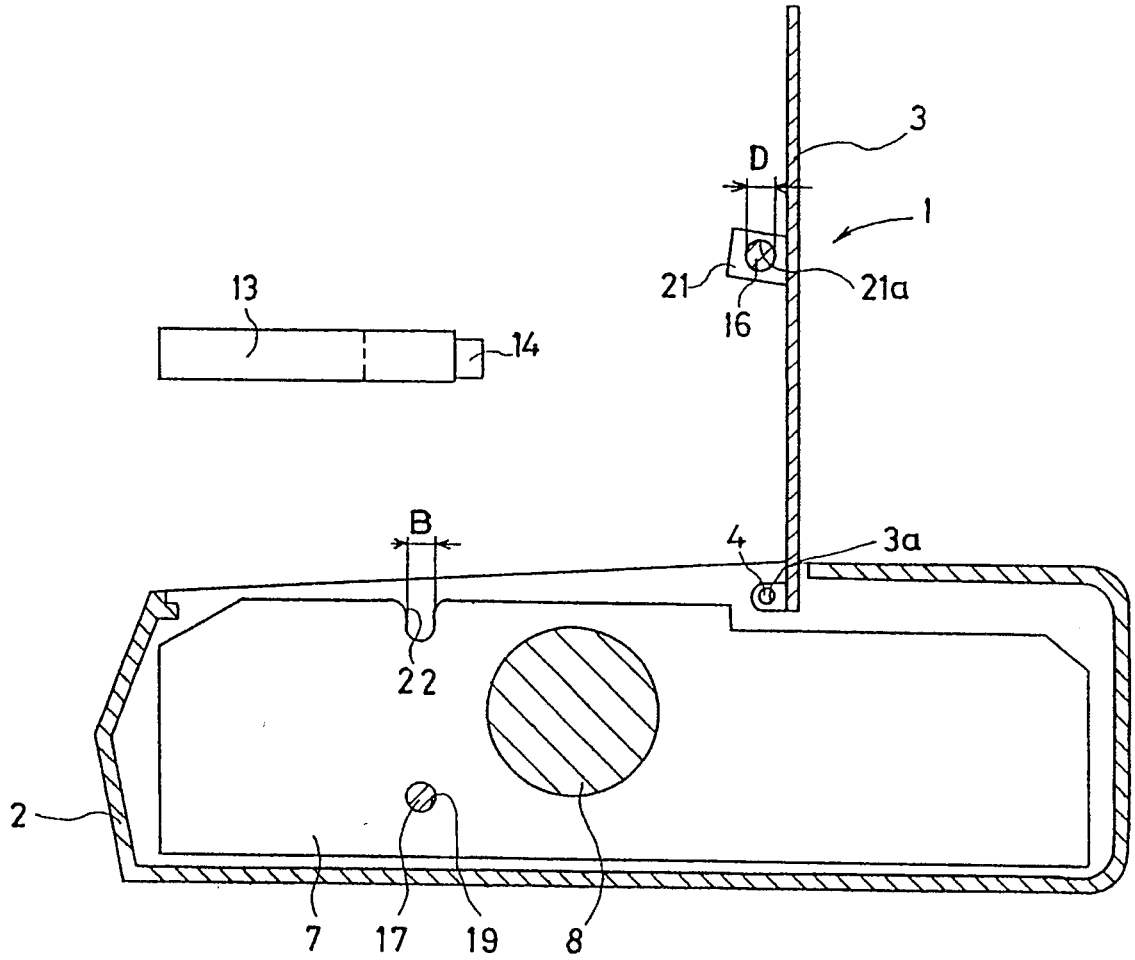

On the contrary, the carrier 15 has its upper portion formed with a U-shaped engaging groove 20 which is opened upward. The upper guide pin 16 is slidably engaged by the engaging groove 20 and attached to the back of the printer cover 3 exemplifying the opening and closing member. Specifically, the printer cover 3 is equipped at its back with mounting brackets 21 which have their mounting holes 21*a* holding the guide pin 16, as also shown in FIGS. 2 and 4. As a result, the guide pin 16 can be engaged downward with or disengaged from the engaging groove 20 by opening or closing the printer cover 3.

Thus, when the printer cover 3 is opened, the guide pin 16 is disengaged from the engaging groove 20 of the carrier 15 so that the carrier 15 can be turned on the lower guide pin 17.

The mounting hole 21*a* of the printer cover 3 for holding the guide pin 16 and the fitting hole 3*a* of the pin 4 for connecting the printer cover 3 to the printer casing 2 in an openable or closable manner have considerable clearances, which in turn disable the guide pin 16 to be precisely positioned. In order to warrant the precise positioning of the guide pin 16, therefore, the following structure is adopted.

The upper side of the frame 7 supporting the platen 8 and the guide pin 17 is formed, as shown in FIG. 4, with a U-shaped positioning groove 22, which is engaged by the guide pin 16 when the printer cover 3 is closed. The positioning groove 22 has its width B set to be substantially equal to the diameter D of the guide pin 16 so that the guide pin 16 comes into engagement with the positioning groove 22 without any clearance. As a result, when the printer cover 3 is closed, the position of the guide pin 16 in rightward and leftward directions of FIG. 4 relative to the platen 8 is precisely established by the positioning groove 22.

Around the carrier 15, there is erected a block 23 for restricting the rotations of the carrier 15 within a predetermined range so that the guide pin 16 can be reliably engaged with the engaging groove 20 of the carrier 15 and the positioning groove of the frame 7 by the closing action of the printer cover 3.

Next, the operations of the present invention will be described in the following.

When the recording paper 6 is to be set, the pinch roller 11 is brought apart from the platen 8. In this state, the recording paper 6 is threaded from the opening 5 through the clearance between the pinch roller 11 and the platen 8 into the clearance between the platen 8 and the ink ribbon 14.

After the recording paper 6 has been set, the pinch roller 11 is brought into elastic contact with the platen 8 through the recording paper 6 to clamp the recording paper 6 between itself and the platen 8.

For the printing operation, the printing head 12 is carried by the carrier 15 in parallel with the platen 8 to print the recording paper 6. Renewal of the line is accomplished when the recording paper 6 is advanced by rotating the platen 8. After the printing operation, the recording paper 6 is discharged through the opening 5 to the outside of the printer casing 2.

In the serial printer 1 thus printing the recording paper 6, one guide pin 16 is disengaged from the engaging groove 20 of the carrier 15 and the positioning groove 22 of the frame 7, when the printer cover 3 is opened, so that the carrier 15 can be turned on the lower guide pin 17.

As a result, at the time of charging the ink ribbon cassette 13, for example, the printer cover 3 is opened, and the carrier 15 is then turned on the guide pin 17 to bring the printing head 12 apart from the platen 8. Then, the clearance between the printing head 12 and the platen 8 is enlarged to facilitate insertion of the ink ribbon 14 into the clearance between the nose portion 12*a* and the platen 8 and accordingly the charge of the ink ribbon cassette 13. Since, moreover, the clearance between the printing head 12 and the platen 8 can be enlarged, clogging paper, if any, can be easily removed.

With the printer cover 3 being opened, on the other hand, the turn of the carrier 15 is restricted by the block 23 so that the guide pin 16 can be reliably brought downward into engagement with the engaging groove 20 of the carrier 15 and the positioning groove 22 of the frame 7 when the printer cover 3 is closed. This makes the operations troubleproof after the charge of the ink ribbon cassette 13 or after the clogging with the paper.

Figure 9:
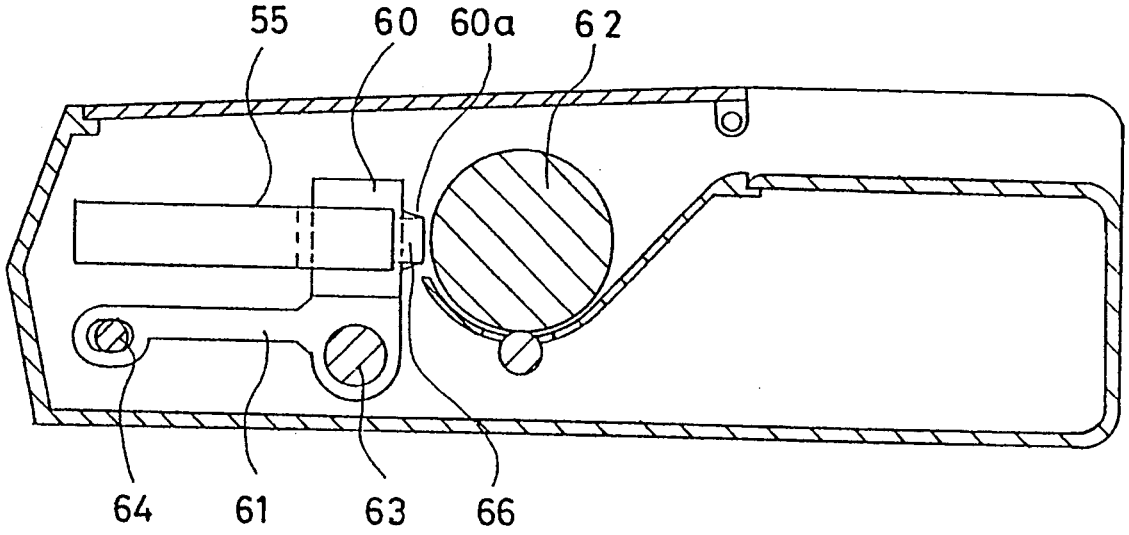
FIG. 9 is a schematic section showing the structure of the serial printer of the prior art.

Since, moreover, the carrier 15 is supported at its upper and lower two end portions by the guide pins 16 and 17, the carrier 15 can be made compact in the horizontal direction. As a result, there is established below the ink ribbon cassette 13 such a larger space than that of the structure of the prior art (as shown in FIG. 9) as can be arranged with other mechanisms or electric circuits while keeping the whole structure of the printer compact.

In the embodiment thus far described, the guide pin 16 is made as another part separate from the printer cover 3 but can be formed integral with the printer cover 3.

In the foregoing embodiment, moreover, the carrier 15 is formed with the engaging groove 20 which is enabled to engage or disengage the guide pin 16 by opening or closing the printer cover 3. However, the carrier 15 can be formed with an engaging ridge so that a guide member having a recess to come into engagement with that ridge may be held by the printer cover 3.

In the foregoing embodiment, still moreover, the ink ribbon cassette 13 is held in the frame 7 but may be held in the carrier 15.

Figure 5:
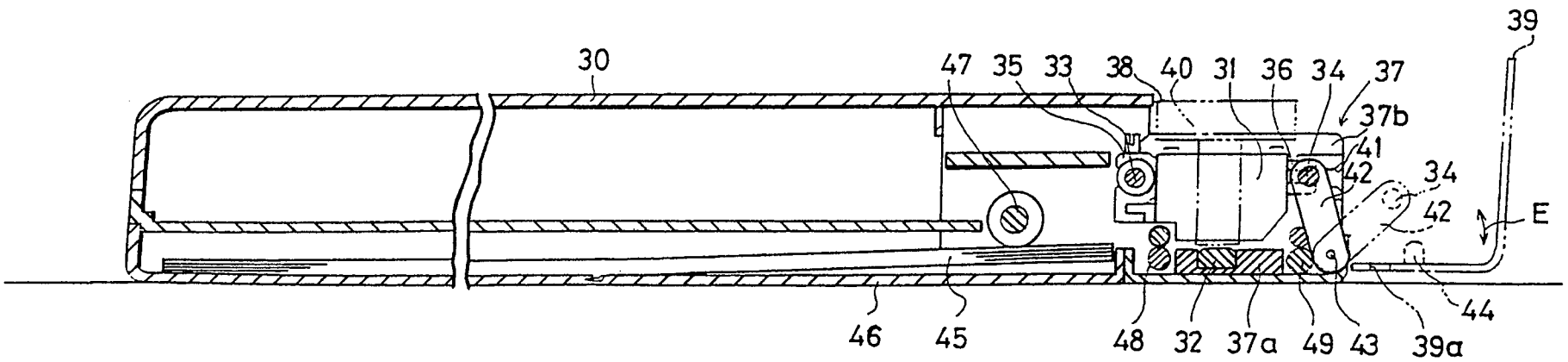
FIGS. 5 to 8 are longitudinal sectional views showing second to fifth embodiments of the present invention.

FIG. 5 shows a second embodiment of the present invention.

In this embodiment, a thin box-shaped printer casing 30 is equipped inside of its one (i.e., right-hand) side with a printing head 31, which is so supported by a pair of guide members or guide pins 33 and 34 extending in parallel with a platen 32 that it can move in the longitudinal direction of the guide pins 33 and 34. The printing head 31 is integrally formed at its one side with sliders 35, which are slidably fitted on one guide pine 33, and at its other side with engaging brackets 36 which are slidably fitted on the other guide pin 34. Thus, the printing head 31 is supported on the guide pins 33 and 34 through the sliders 35 and the engaging brackets 36. This engaging brackets 36 are formed into a shape of the letter U opened sideways to engage with one guide pin 34 in a disengageable manner. The directions of bringing the guide pin 34 into and out of engagement with the engaging brackets 36 are at a right angle with respect to the extending direction of that guide pin 34.

The printer casing 30 is arranged therein with a printer frame 37 which is constructed by erecting side plates 37*b* (only one of which is shown in FIG. 5) from the two sides of a bottom plate 37*a*. This bottom plate 37*a* fixes the platen 32 therein, and the side plates 37*b* support the guide pin 33 stationarily.

The printer casing 30 has its one side formed in the vicinity of the printing head 31 with an opening 38 which is closed with an openable cover 39. The opening 38 is sufficiently sized to insert or remove a ribbon cassette 40 and to turn the printing head 31 on the guide pin 33. The openable cover 39 is connected to the side plate 37*b* of the printer frame 37 by a not-shown hinge means so as to be either opened to the position, as indicated by double-dotted lines, or closed in the direction of arrow E. The ribbon cassette 40 is charged with a not-shown ink ribbon, which is threaded, when it is to be set, into the clearance between the printing head 31 and the platen 32.

Moreover, the guide pin 34 has its two end portions engaged removably by a U-shaped positioning groove 41 which is formed in the side plate 37*b* of the printer frame 37. The directions of bringing the guide pin 34 into and out of engagement with the positioning groove 41 are at a right angle with respect to the extending direction of that guide pin. The positioning groove 41 positions the guide pin 34 with respect to the guide pin 33. When the guide pin 34 is apart from the engaging brackets 36, it is apart from the positioning groove 41, too.

To the guide pin 34, there is swingably connected one end of a swinging arm 42 which acts as a movable member. This swinging arm 42 has its other end hinged through a pin 43 to the lower portion of each side plate 37*b* of the printer frame 37 so that it can swing on the pin 43. The swinging arm 42 is provided for moving the guide pin 34 into and out of engagement with the engaging brackets 36 and the positioning groove 41.

As a result, one guide pin 34 can be brought into and out of engagement with the engaging brackets 36 and the positioning groove 41 by the swinging motions of the swinging arms 42.

In order that the guide pin 34 engaged by the positioning groove 41 may not come out unexpectedly, the openable cover 39 has its inner side formed with a holding projection 44, which is engaged by the positioning groove 41, when the openable cover 39 is closed, to prevent the guide pin 34 from coming out of the positioning groove 41.

In the bottom portion of the printer casing 30, there is disposed a paper feed cassette 46 for reserving sheets of recording paper 45. This paper feed cassette 46 can be drawn (to the left of FIG. 5) and is overlaid by a picking roller 47. The recording paper 45 is pushed onto the picking roller 47 by not-shown bias means. The picking roller 47 can be rotated by the drive force of a not-shown drive means so that the recording paper 45 can be taken out of the paper feed cassette 46. The recording paper 45 thus taken out of the paper feed cassette 46 is fed into the clearance between the platen 32 and the ink ribbon by the action of a paper feed roller 48 until it is discharged to the outside from the exit 39*a* of the openable cover 39 by the action of a paper discharge roller 49. The picking roller 47, the paper feed roller 48 and the paper discharge roller 49 are individually supported by the side plates 37*b* of the printer frame 37.

According to the structure thus far described, the openable cover 39 is opened, as indicated by double-dotted lines, and the swinging arm 42 is swung clockwise on the pin 43. Then, one guide pin 34 comes out of the engaging brackets 36 and the positioning groove 41 so that the printing head 31 can be turned on the other guide pin 33 and moved apart from the platen 32.

At the time of setting the ink ribbon, therefore, the printing head 31 can be turned, if necessary, on the other guide pin 33 to widen the clearance between the printing head 31 and the platen 32 thereby to facilitate the setting of the ink ribbon.

Figure 6:
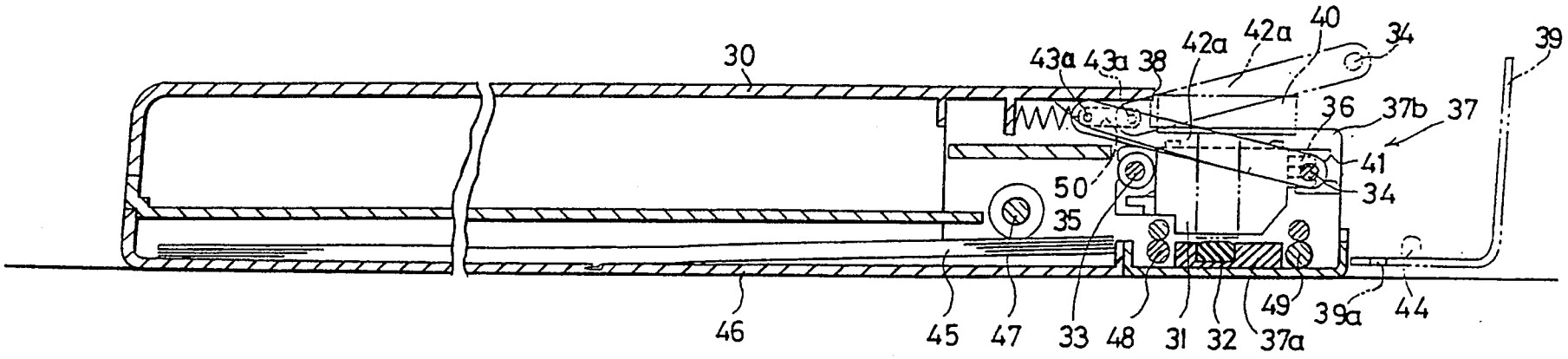
Figure 7:
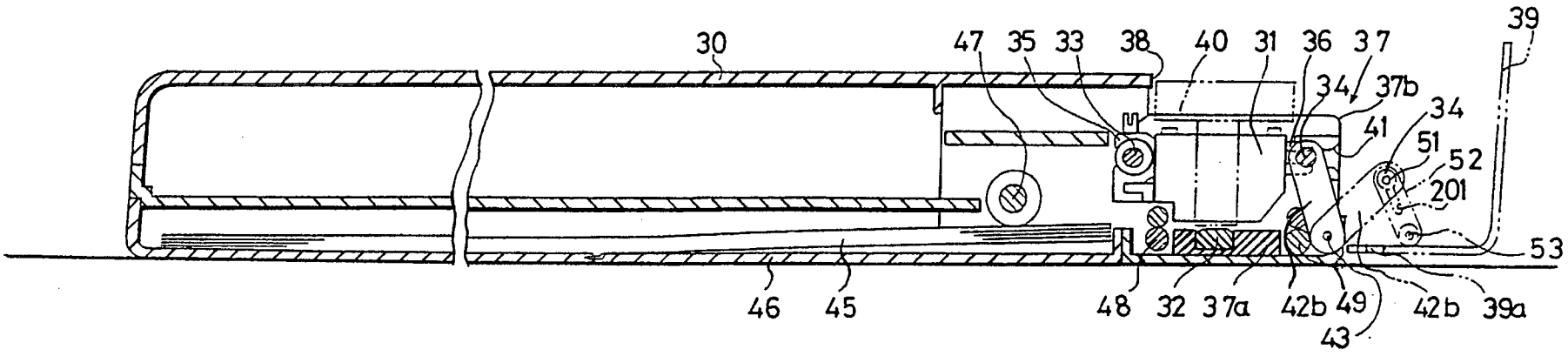
Figure 8:
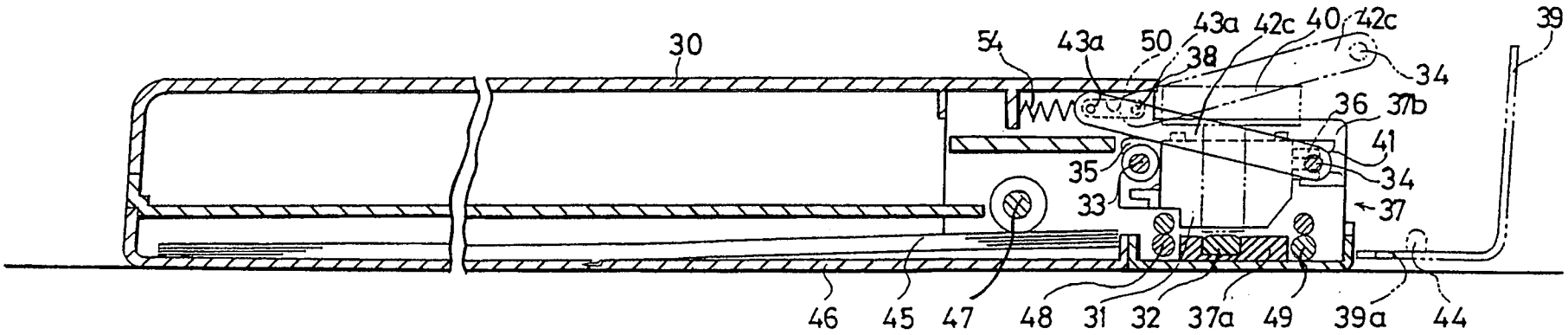

Third to fifth embodiments of the present invention are individually shown in FIGS. 6 to 8.

In these embodiments, the swinging mechanisms of the swinging arm 42 are different from that of the second embodiment, but the remaining structure is substantially identical to that of the second embodiment. The components corresponding to those of the second embodiment are designated by reference numerals identical to those of the second embodiment.

In the third embodiment, as shown in FIG. 6, a swinging arm 42*a* is swingably attached at its end portion opposite that for supporting the guide pin 34 to upper portions of the side plates 37*b* of the printer frame 37 through pins 43*a* such that it can swing on those pins 43*a*. These pins 43*a* can slide to the right and left of FIG. 6 in slots 50 which are formed in the side plates 37*b* of the printer frame 37.

In case, therefore, the guide pin 34 is to be removed from the engaging brackets 36 and the positioning groove 41, it is sufficient to open the openable cover 39, to move the guide arms 42*a* to the right along the slots 50 and to swing the guide arms 42*a* counter-clockwise on the pin 43*a*, as indicated by the double-dotted lines, in the vicinity of the terminals of those slots 50.

In the fourth embodiment, as shown in FIG. 7, there is swingably connected to one end of each of swingable arms 42*b* through a pin 51 concentric to the guide pin 34 one end of a link 52, which has its other end connected swingably to the inner side of the openable cover 39 through a connect pin 53. The links 52 are provided for bringing one guide pin 34, when the openable cover 39 is to be opened, out of engagement with the aforementioned engaging brackets 36 and the positioning groove 41 and, when the cover 39 is to be closed, into engagement with the engaging brackets 36. When the openable cover 39 is to be opened, as indicated by double-dotted lines, the swingable arms 42*b* are accordingly swung clockwise on the pin 43 so that the guide pin 34 automatically moves apart from the engaging brackets 36 and the positioning groove 41. The links 52 are slotted at 201 for receiving the pins 51 so that the swinging arms 42*b* and the openable cover 39 are connected in an associated manner.

In the fifth embodiment, as shown in FIG. 8, swinging arms 42*c* are provided like those 42*a* of the foregoing third embodiment, and push springs 54 such as compression springs are provided for biasing the swinging arms 42*c* to the right of FIG. 8, i.e., in such a direction that the guide pin 34 is moved apart from the engaging brackets 36 and the positioning groove 41.

When the openable cover 39 is opened, the swinging arms 42*c* are moved to the right by the forces of the push springs 54 so that the guide pin 34 is automatically moved apart from the engaging brackets 36 and the positioning groove 41.

The swinging arms are swingably supported by the printer frame 37 in the foregoing second to fifth embodiments but may be swingably supported by the printer casing 30. The supporting member should not be limited to the printer frame 37 and the printer casing 30 but may be other stationary members for supporting the swinging arms.

In the second to fifth embodiments, moreover, the moving members are exemplified by the swingable arms so that one guide pin 34 can be brought into and out of engagement with the engaging brackets 36 by the swinging motions of the swinging arms. However, the moving members may be exemplified by slidable sliders for bringing the guide pin 34 into and out of engagement with the engaging brackets 36 by the sliding motions of the sliders.

In the second to fifth embodiment, still moreover, the printing head 31 is formed integrally with the engaging brackets 36 but may be formed with other separate engaging brackets. For example, the printing head 31 may be carried on the carrier which is formed with the engaging brackets.

In the serial printer according to the present invention, as has been described hereinbefore, one of the paired guide members is attached to the openable member so that it may be brought into and out of engagement with the carrier by operating the openable member. As a result, one guide member can be disengaged from the carrier by the operation of the openable member to move the printing head, if necessary, apart from the platen thereby to facilitate setting of the ink ribbon and the recording paper. According to the structure of the present invention, moreover, there can be established below the ink ribbon cassette a space which can be arranged therein with another mechanism or an electric circuit, so that the printer can be made compact in its entirety.

Even if, on the other hand, one guide member is brought into and out of engagement with the engaging brackets of the printing head by the displacement of the moving members, the clearance between the printing head and the platen can be widened, if necessary for setting the ink ribbon or the like, to facilitate the ink ribbon setting.

If, in this case, the engaging brackets are formed integrally with the printing head, the number of parts can be reduced to simplify the structure.

If, moreover, the moving parts are swingably supported in either the printer casing or the printer frame positioned in the printer casing, one of the guide members can be positioned with ease and without fail.

If, still moreover, the printer frame is formed with the positioning groove for allowing one guide member to engage therewith or disengage therefrom, the guide member can be positioned without fail and supported in a stable state.

If, furthermore, the links are interposed for connecting the openable cover and the moving parts in the associated manner so that one guide member may be moved, when the openable cover is opened, to the positions disengaged from the engaging brackets and, when the openable cover is closed, to the positions engaged with the engaging brackets, the guide member can be automatically brought into and out of engagement with the engaging brackets.

Further embodiments of the invention are shown in FIGS. 10 to 15.

Figure 10:
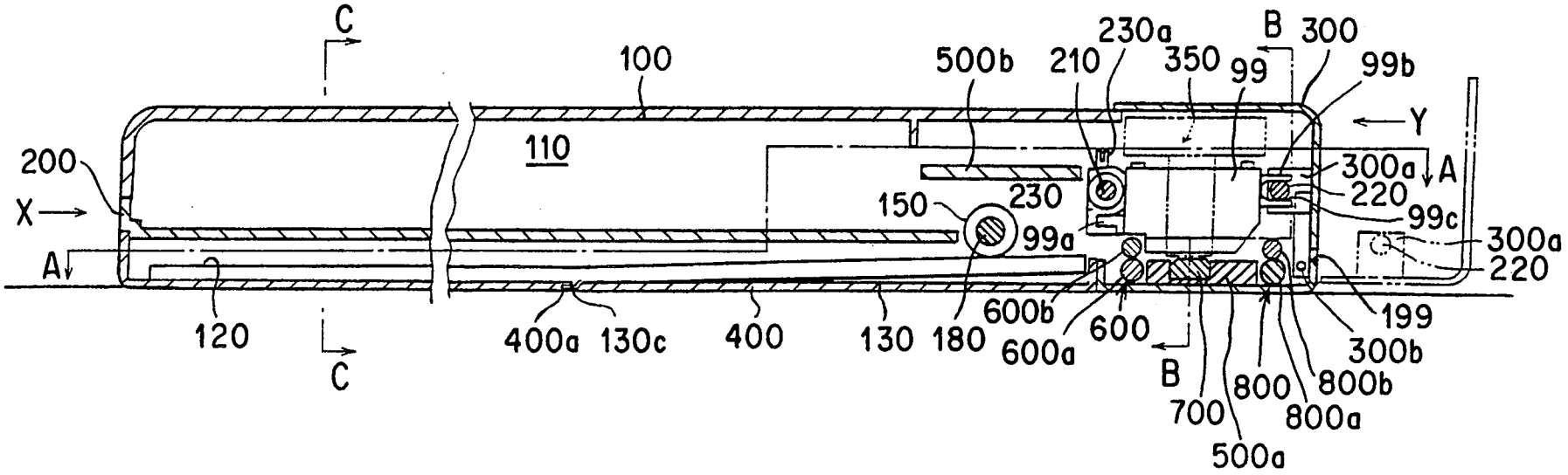
FIG. 10 is a sectional view, taken in the direction in which a sheet of paper is fed or transported, of another embodiment of a printer.

Referring to FIG. 10, a printer casing comprises an upper case 100 whose top surface is flat, a lower case 200 and a front cover 300. A space for storing therein a paper feed cassette 400 is defined over the upper surface of the lower case and frames 500*a* and 500*b* are securely mounted thereon.

The sheet feed cassette 400 is placed on the side of the rear portion of the support surface of the lower case 200 and a sheet feed roller assembly 600, a platen 700 and a sheet discharge roller assembly 800 are arranged in the order named from the leading edge of the cassette 400 toward the front cover 300. A printing head 99 is disposed in opposing relationship with the platen 700.

Figure 13:
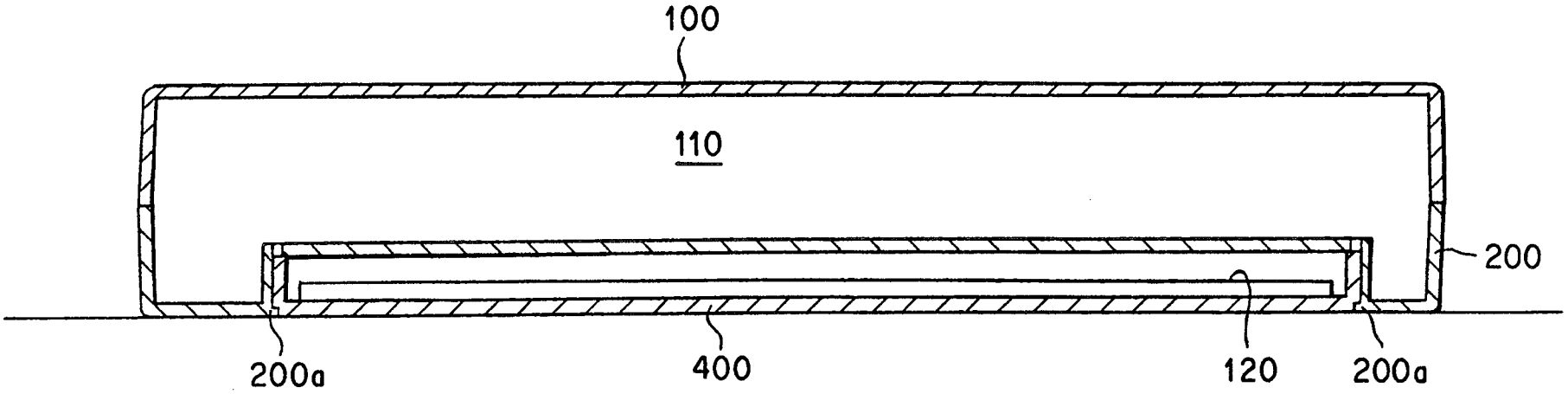
FIG. 13 is a sectional view taken along the line C—C of FIG. 10.

The sheet cassette 400 is in the form of a box with the top wall thereof removed and is loaded in the printer in the direction indicated by the arrow X. When the sheet cassette 400 is loaded, the bottom surface thereof is substantially in coplanar relationship with the bottom surface of the lower case 200. More specifically, as shown in FIG. 13, the sheet cassette loading space of the lower case 200 is a recess formed by drawing or any other suitable method and has steps 200*a* spaced apart from each other by a predetermined distance in the sheet feeding direction and in opposing relationship with each other. The sheet cassette 400 is loaded into the recessed loading space of the lower case 200 and is engaged with the steps 200*a* in such a way that the bottom surface of the sheet cassette 400 is in coplanar relationship with the bottom surface of the lower case 200. A driving circuit, which is, for example, in the form of a printed circuit board is disposed in the space 110 defined by the upper surface of the recessed sheet cassette loading space in the lower case 200 and the lower surface of the upper case 100.

Figure 11:
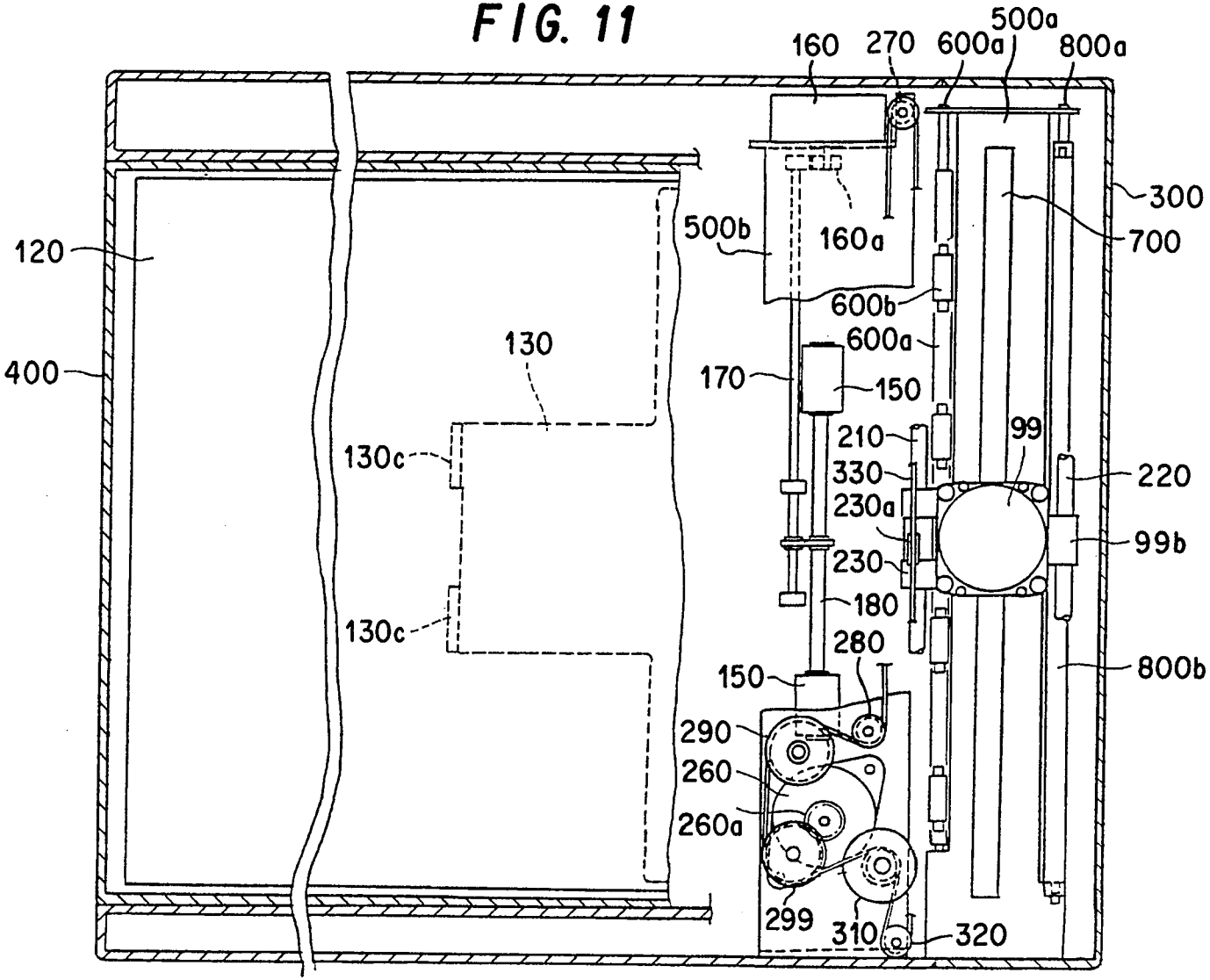
FIG. 11 is a sectional view taken along the line A—A of FIG. 10.

A plurality of recording paper sheets 120 are inserted in the opened top of the sheet cassette 400 and are disposed one over another. As best shown in FIG. 11, a hopper plate 130 is securely mounted on the bottom surface at the front portion of the sheet cassette 400. It is in the form of a letter T and projections 130*c* extended from the end of the vertical portion of the T are engaged with engaging recesses 400*a* of the sheet feed cassette 400 in such a way that the sheet cassette 400 can pivot about the projections 130*c*. A bias means (not shown) is disposed under the hopper plate 130 so that the leading end portion of the hopper plate 130 is normally biased upwardly so that the uppermost recording sheet stacked in the sheet cassette 400 is forcibly pressed against picking rollers 150. As best shown in FIG. 11, a new paragraph stating motor 160 (to be referred to as "a return motor" hereinafter in this Specification) rotates through a gear train 160*a* a shaft 170 and furthermore also through a gear train rotates a shaft 180 which carries the picking rollers 150 on the right and left side portions, respectively, thereof. Each picking roller 150 incorporates therein a clutch (not shown) so that after the picking rollers 150*a* draw the upper most recording sheet 120 in the sheet cassette 400 and then feeds it into the sheet feed roller assembly 600, the picking rollers 150 start racing or idling.

The frame 500*a* is securely attached to the bottom surface of the lower case on the upstream side of the recording sheet cassette 400 and the platen 700 is extended and disposed over the frame 500*a* in the widthwise direction thereof in such a way that the surface of the platen 700 in contact with a recording sheet 120 is directed upwardly. The feed and discharge roller assemblies 600 and 800 are supported in parallel with the platen on the upper surface of the lower case 200 on the downstream side and the upstream side, respectively, of the platen 700.

The feed roller assembly 600 comprises driving feed rollers 600*a* and pinch rollers 600*b* each in contact with the top of the driving feed roller 600*a*. In like manner, the sheet discharge roller assembly 800 comprises a driving roller 800*a* and a pinch roller 800*b* in contact with the top of the driving roller 800*a*. The linear contact lines between the driving feed rollers 600*a* and 800*a* on the one hand and the pinch rollers 600*b* and 800*b* on the other hand have substantially the same height as the upper surface of the platen 700. Both the driving rollers 600*a* and 800*a* are rotated through gear trains (not shown), respectively, by the return motor 160. The driving roller 800*a* and the pinch roller 800*b* of the discharge roller assembly 800 are substantially in the form of a cylinder having the same cross section throughout the axes thereof and the plane perpendicular to the linear contact line between the driving roller 800*a* and the pinch roller 800*b* is in parallel and in opposing relationship with an opened surface of a discharge opening 199 (see FIG. 15). The sum of the diameters of the driving and pinch rollers 800*a* and 800*b* is greater than the width of the discharge opening 199 and the lengths of the driving and pinch rollers 800*a* and 800*b* are longer than the length of the discharge opening 199. In other words, when the discharge opening 199 is viewed from the front side, the discharge opening 199 is closed by both the driving and pinch rollers 800*a* and 800*b*.

The printing head 99 is of the impact type which extends printing wires (not shown) to print a letter and reciprocates along a first guide rod 210 and a second guide rod 220 with the printing portion of the printing head 99 being directed downwardly. Fitted slidably over the first guide rod 210 is a slider 230 which has a hole substantially equal to the other diameter of the first guide rod 210 and whose inner cylindrical surface is fitted with a cylinder member (not shown) whose outer cylindrical surface is coated with a plastic or the like in order to minimize the friction between the inner surface of the slider and the outer cylindrical surface of the first guide rod 210. The slider 230 is formed with a groove extending along the underside portion thereof and a projection 99*a* extended from the rear surface of the printing head 99 is securely attached to the groove with screws or the like (not shown). Thus, one end portion of the printing head 99 is slidably carried through the slider 230 by the first guide rod 210. A receiving portion 99*b* is formed integral with and extended forwardly from the front end portion of the printing head 99; that is, the position opposite to the slider 230 and has a U-shaped groove 99*c* whose opening is directed forwardly and into which is fitted the second guide rod 220. The second guide rod 220 is securely attached through brackets 300*a* in parallel with the first guide rod 210 to the cover 300 (see FIG. 15) which in turn is pivotably supported by the frame 500*a* with pins 300*b*. (In FIG. 11, the bracket 300*a* is not shown).

Figure 15:
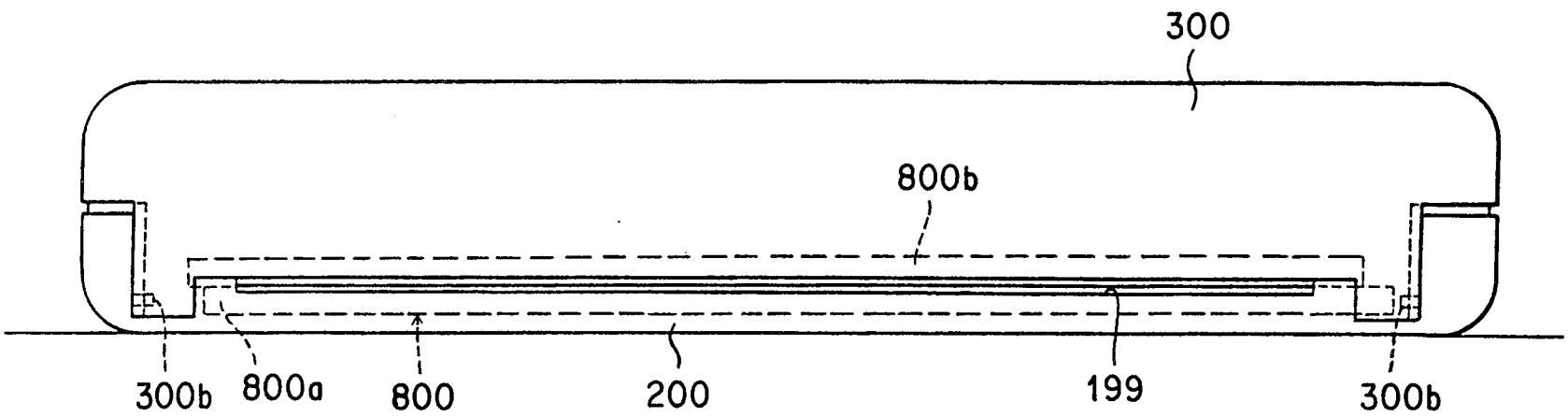
FIG. 15 is a front view of the printer shown in FIG. 10.

The cover 300 has an L-shape cross section and is so designed and constructed as shown in FIGS. 10 and 15 to define the upper surface portion at the front portion of the printer case. When the cover 300 is closed, the leading end thereof is in contact with the front end portion of the upper case 100, but when the cover 300 is opened, the front portion of the printer case is exposed. Furthermore, when the cover 300 is closed, as best shown in FIG. 15, the side edges at the front portion of the cover 300 are disposed in opposing relationship with those of the lower case 200. The lower case 200 is formed with an elongated groove and a slit defined by this groove and the front side edge of the cover 200 defines the discharge opening 199.

Next the mode of operation of a printing head 99 will be described. As shown in FIG. 11, a carriage motor 260 is mounted on the left side of the frame 500*b* and pulleys 220, 280, 290, 299, 310 and 320 are disposed above the frame 500*b*. The carriage motor 260 and the pulleys 270, 280, 290, 299, 310 and 320 do not interfere with the displacement region of the printing head 99; that is, they are not coplanar with the displacement region of the slide 230 and the receiving portion 99*b* and are disposed at positions which are not located at the extended area of the displacement region of the printing head unit; that is, at positions to one side of the displacement of the printer head unit. As shown in detail in FIG. 14, a gear 299*a* is formed integral with the pulley 299 and is in mesh with a pinion 260*a* of the carriage motor 260. A U-shaped projection 230*a* is formed at the upper end of the slider 230 and a portion of an endless timing belt 330 is fitted into the projection. The timing belt 330 is wound around the pulleys 220, 280, 290, 299, 310 and 320 in a zig-zag form. More specifically, the timing belt 330 is wound outwardly around the pulleys 290 and 299, inwardly around the pulleys 280 and 310 and outwardly around the pulleys 220 and 320 which are disposed at both ends, respectively, of the frame 500*b* in such a way that the timing belt extends straight between the pulleys 220 and 320 and is spaced apart from the projection 99*b* in the lengthwise direction. When the carriage motor 260 is energized, the printing head 99 is driven through the timing belt 330. The carriage motor 260 is a reversible motor so that reciprocal movement or displacement of the printing head 99 is obtained.

Figure 12:
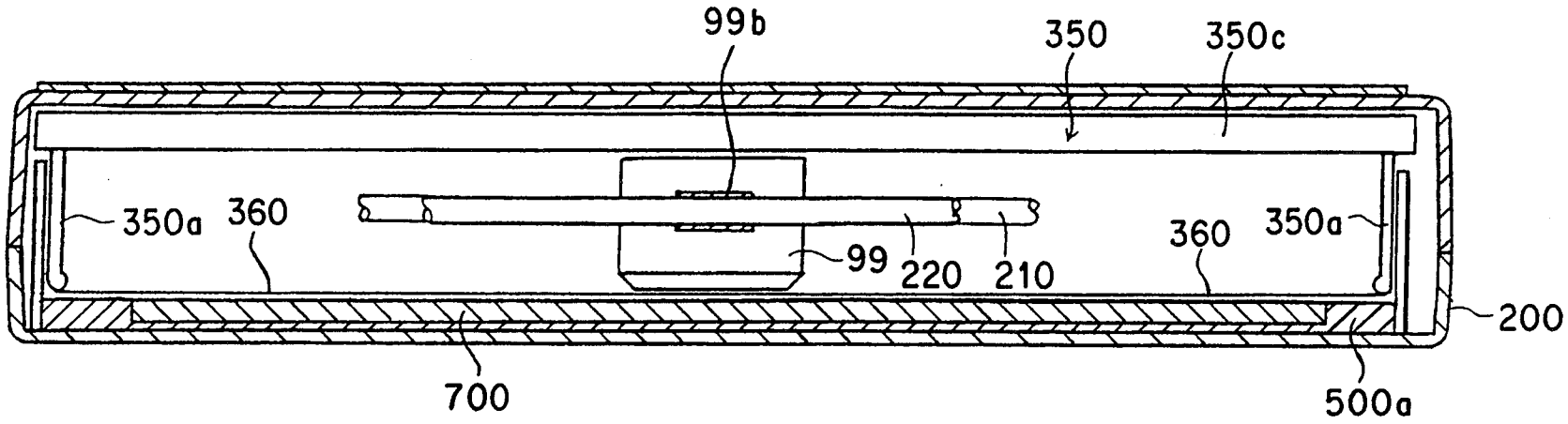
FIG. 12 is a sectional view taken along the line B—B of FIG. 10.

A ribbon cassette 350 is disposed above the printing head 99 and has two arms 350*a* extended from both ends of the cassette 350. An ink ribbon 360 drawn from the ribbon cassette 350*a* is vertically extended along one of the arms 350*a* and turns at the lower end thereof and extends into the space between the platen 700 and printing head 99 to the lower end of the other arm 350*a* as best shown in FIG. 12. The main body 350*c* has a space therein in which the ink ribbon 360 is stored in the form of a zig-zag folded form. The ribbon cassette 350 is easily loaded in the direction indicated by the arrow Y into the printer to a predetermined position when the cover 300 is opened.

More specifically, the cover 300 carries the second guide rod 220 and when the cover 300 is opened the second guide rod 220 disengages from the engaging portion 99*b* so that the print head 99 is supported only by the first guide rod 210 and is permitted to rotate about the rod 210. Therefore, the space between the printing head 99 and the platen 700 is not fixed any longer so that the ink ribbon 360 can be easily threaded.

Figure 14:
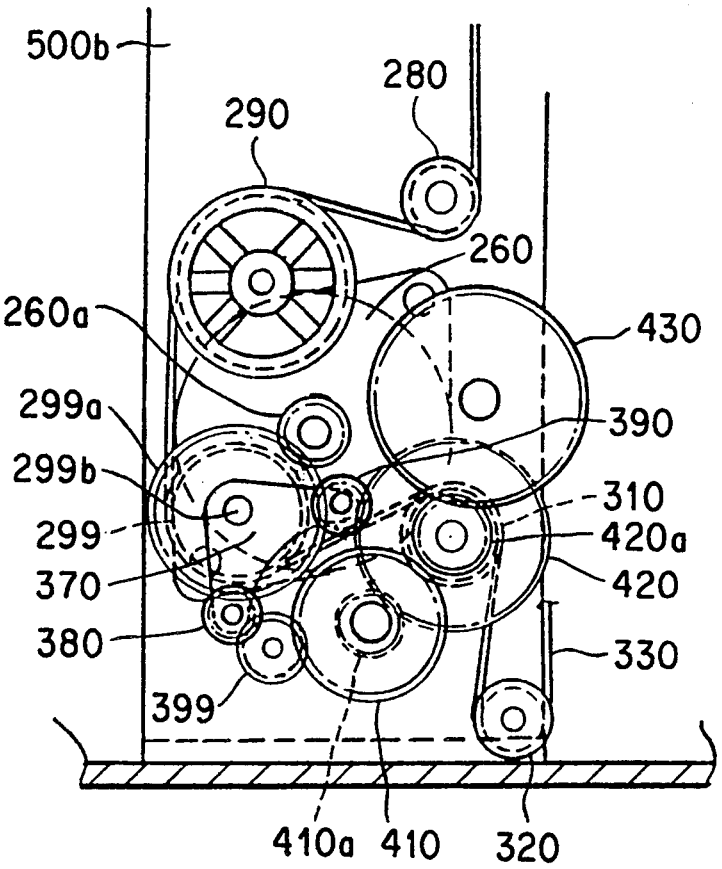
FIG. 14 is a view, on an enlarged scale, illustrating a carriage motor, a ribbon driving wheel and other components in the vicinity thereof.

Next, the mode of operation of the ribbon cassette 350 will be described with reference to FIG. 14. An L-shaped lever or rocker 370 is securely attached to the shaft 299*b* of the pulley 299 and carries idlers 380 and 390 at both ends thereof, respectively, and swings about the shaft 299*b* of the lever or rocker 370*b* in unison with the pulley 299*a* because of the strong friction contact between them. Therefore, when the pulley 299 rotates in the counterclockwise direction , the rocker 370 is forced to rotate in the counterclockwise direction so that the idler 380 is caused to mesh with the gear 399 which in turn is in mesh with the gear 410. A pinion 410*a* of the gear 410 is in mesh with the gear 420 coaxial with the pulley 310. The pulley 310 and the gear 420 are coaxial, but they rotate independently of each other and a pinion 420*a* of the gear 420 is in engagement with a ribbon driving gear 430 so that the latter is caused to rotate in the clockwise direction. On the other hand, when the gear 299 rotates in the clockwise direction, the idler 390 is made to mesh with the gear 410 to rotate the same so that the ribbon driving gear 430 is caused to rotate in the clockwise direction.

The ribbon cassette 350 incorporates therein a pair of ribbon feed rollers (not shown) for engagement with the ink driving gear 430 so that the ribbon feed rollers cause the ink ribbon 360 to run along one of the arms 350*a* of the ink ribbon cassette 350. It should be noted that the ink ribbon 360 is stored in the lengthwise direction within the main body 350*c* and is turned at a right angle when the ink ribbon 360 is drawn from its storage cassette 350 to one of the arms 350*a* thereof.

In the case of the printer with the above-mentioned construction, an uppermost recording sheet 120 of the recording sheets stored in the recording sheet cassette 400 is drawn out of it by the picking rollers 150 and is fed by the feed roller assembly 600 into the space between the printing head 99 and the platen 700 in a substantially horizontal state. Then, in response to a printing signal, the carriage motor 260 is energized to transmit its rotating force to the pulley 299. Then the timing belt 330 is driven so that the slider 230, the printing head 99 and the engaging portion 99*b* are caused to move along the guide rods 210 and 220. At a printing position, predetermined printing wires within the printing head 99 are forcibly ejected therefrom to strike the recording sheet 120 through the ink ribbon, whereby a predetermined letter is printed over the surface of the recording sheet 120. In this case, the guide rods 210 and 220 are disposed on both sides of the platen 700 or the printing head 99 so that the impact force produced by the above-described printing operation is equally shared by the guide rods 210 and 220 so that both guide rods 210 and 220 may have the substantially equal and small diameter.

The recording sheet 120 which is printed by the printing head 99 is fed by the force of the recording sheet feeding roller assembly 600 into the discharge roller assembly 800 in the substantially horizontal state and then discharged out of the printer through the discharge opening 199.

In the case of the exchange of the ribbon cassette 350, when the stored ink ribbon 360 is exhausted, by a new ribbon cassette 350, first the cover 300 is opened so that the second guide rod 220 is swung in unison with the rotation of the cover 300 and disengaged from the engaging portion 99. Next, the empty ribbon cassette 350 is removed out of the printer through the space between the receiving portion **99*b* and the guide rod 220 and a new ribbon cassette 350 is loaded into the printer. In this case, because the cover 300 is opened, the printing head 99 is supported only by the first guide rod 210. Then, the printing head 99 is rotated about the first guide rod 210, thereby increasing the space between the printing head 99 and the platen 700 and consequently an ink ribbon cassette 360** can be loaded into or unloaded from the printer in a simple manner.

In the case of the printer whose mode of operation is as just described above, the sliders 230 of the first guide rod 210 and the engaging portion **99*b* of the second guide rod 220 are disposed independently of each other at both ends of the printing head 99 as printing head impact damping means so that the engaging portions of the first and second guide rods 210 and 220 can be made simple in construction and compact in size. In addition, since the engaging portion 99*b* of the second guide rod 220 is formed integral with the printing head 99**, the number of components can be reduced to a minimum and accordingly the costs of the printers to which the present invention is applied can be made low.

In the preferred embodiment of the present invention, of the engaging means which are slidably fitted over the first and second guide rods 210 and 220, only one engaging means has been described as being formed integral with the printing head 99 while the other engaging means or sliders are fabricated independently of the printing head, but it is to be understood that both engaging means can be formed integral with the printing head. For instance, in the case of a small-sized printing head whose slidability must be especially taken into consideration, small-sized independent components can be securely attached to the printing head so that the object of the present invention can be attained without adversely affecting the compactness in size and inexpensive costs of the printing head.

So far the guide rods have been described as being extended in parallel with the printing surface of the printing head, but it is to be understood that the guide rods can be extended at right angles relative to the printing surface of the printing head in parallel and opposing relationship with each other.

Furthermore, the guide rods have been described as being disposed in parallel and opposing relationship with each other in such a way that one or more printing wires are projected vertically from the printing head toward the platen disposed below and in parallel with the guide rods, but in order that both the guide rods equally receive the impact load produced in the case of printing, the guide rods can be disposed on both sides, respectively, of the printing head and it is not necessary that the guide rods are extended horizontally and in opposing relationship with each other.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What we claim is:

1. In a printing head guide device comprising a printer casing means, a carrier means carrying a printing head, a pair of parallel guide rods for guiding said carrier means disposed in said printer casing means, said carrier means having one side thereof formed with engaging means for slidably engaging one of said guide rods, said one guide rod being mounted in a fixed position on said printer casing means, said printer casing means having mounting means movable between engaged and non-engaged positions, the other of said guide rods being mounted on said mounting means such that when in said engaged position, said other guide rod slidably supports said printing head and when in said non-engaged position, said other guide rod is spaced from said carrier means, said mounting means comprising a cover movable between open and closed positions, said other guide rod being mounted on said cover.

2. In a printing head guide device according to claim 1, wherein said two guide rods extend on opposite sides of said carrier means.

3. In a printing head guide device according to claim 1, wherein said mounting means detachably attaches said other guide rod to said carrier means.

4. In a printing head guide device according to claim 1, wherein said engaging means is formed integral with said carrier means.

5. In a printer comprising a carrier means carrying a printing head, a printer casing means, a pair of parallel guide rods on said printer casing means for guiding said carrier means, mounting means on said printer casing means for mounting one of said guide rods for movement between an engaged position and a non-engaged position, said carrier means having engageable means slidably engaging said one guide rod when said one guide rod is in said engaged position, said engageable means being disengaged from said one guide rod when said one guide rod is in said non-engaged position, and support means supporting said other guide rod in a fixed position on said printer casing means, said printer further comprising a platen, said carrier means being pivotably mounted on said other guide rod between an operable position and a pivoted position, said carrier means being in said operable position when said one guide rod is in said engaged position, said carrier means being pivotal from said operable position to said pivoted position when said one guide rod is in said non-engaged position, the pivoting of said carrier means from said operable position to said pivoted position providing for varying the spacing between said carrier means and said platen, said printer casing means comprising a printer structure, said mounting means being movably mounted on said printer structure for movement between said engaged and said non-engaged positions, said other guide rod being mounted in a fixed position on said printer structure by said support means such that relative movement is effected between said two guide rods when said mounting means moves said one guide rod between said engaged and said non-engaged positions, said mounting means comprising a cover pivotably mounted on said casing.

6. In a printer comprising a printing head, a pair of parallel guide rods for guiding said printing head, mounting means mounting one of said guide rods for movement between an engaged position and a non-engaged position, said printing head having engageable means slidably engaging said one guide rod when said one guide rod is in said engaged position, said engageable means being disengaged from said one guide rod when said one guide rod is in said non-engaged position, a platen, said printing head being pivotably mounted on said other guide rod between an operable position and a pivoted position, said printing head being in said operable position when said guide rod is in said engaged position, said printing head being pivotal from said operable position to said pivoted position when said one guide rod is in said non-engaged position, the pivoting of said printing head from said operable position to said pivoted position providing for varying the spacing between said printing head and said platen;

sheet feed roller means upstream of said platen and sheet discharge roller means downstream of said platen, said sheet feed roller means and said sheet discharge roller means feeding a sheet to be printed linearly past said platen;

a sheet tray containing sheets to be printed, said sheet tray being disposed upstream of said sheet feed roller means, said printer further comprising a discharge outlet downstream of said sheet discharged roller means through which printed sheets are discharged from said printer, the sheets in said sheet tray passing generally linearly to said sheet feed roller means, said printed sheets passing generally linearly from said sheet discharge roller means to said discharge outlet; and a casing, said sheet tray being disposed in a bottom portion of said casing, said discharge outlet comprising a discharge opening in said casing, said casing having a downstream end defined by a pivotal cover, said pivotal cover defining said mounting means which mounts said one guide member.

7. A serial printer comprising a support structure, a platen on said support structure, a printing head means carried on said support structure and movable between a guide position and a displaced position, said printing head means being reciprocated on said support structure to effect printing when said printing head means is in said guide position, and a movable guide means movably mounted on said support structure between an operable position and a displaced position, said movable guide means reciprocably supporting and guiding said printing head means to effect printing when said movable guide means is in said operable position, said printing head means being movable to its displaced position when said movable guide means is in its displaced position, said movable guide means having first engageable means and said printing head means having second engageable means, said first engageable means engaging said second engageable means when said movable guide means is in its operable position, said first engageable means being disengaged from said second engageable means when said movable guide means is in its displaced position, said first engageable means comprising a pin and said second engageable means comprising a U-shaped groove in which said pin is disposed when said movable guide means is in its operable position, said pin being displaced from said U-shaped groove when said movable guide means is in its displaced position, said support structure having positioning means engageable by said first engageable means when said movable guide means is in its operable position, said first engageable means being disengaged from said positioning means when said movable guide means is in its displaced position, said positioning means comprising a U-shaped groove and said first engaging means comprising a guide member disposed in said U-shaped groove when said movable guide means is in its operable position, said guide member being displaced from said U-shaped groove when said movable guide means is in its displaced position.

8. A serial printer comprising a support structure, a platen on said support structure, a printing head means carried on said support structure and movable between a guide position and a displaced position, said printing head means being reciprocated on said support structure to effect printing when said printing head means is in said guide position, and a movable guide means movably mounted on said support structure between an operable position and a displaced position, said movable guide means reciprocably supporting and guiding said printing head means to effect printing when said movable guide means is in said operable position, said printing head means being movable to its displaced position when said movable guide means is in its displaced position, said support structure comprising a casing having an openable member movably mounted on said casing between an open and a closed position, said movable guide means being mounted on said openable member such that when said openable member is in its closed position, said movable guide means is in said operable position and when said openable member is in its open position, said movable guide means is in its displaced position, said openable member being a cover when provides access to said printing head means when in its open position, said cover being pivotably mounted on said casing.

9. A serial printer comprising a support structure, a platen on said support structure, a printing head means carried on said support structure and movable between a guide position and a displaced position, said printing head means being reciprocated on said support structure to effect printing when said printing head means is in said guide position, and a movable guide means movably mounted on said support structure between an operable position and a displaced position, said movable guide means reciprocably supporting and guiding said printing head means to effect printing when said movable guide means is in said operable position, said printing head means being movable to its displaced position when said movable guide means is in its displaced position, said support structure comprising a casing having an openable cover means movably mounted on said casing, said cover means having a closed position when engages said movable guide means to retain said movable guide means in its operable position when said cover means is in its closed position.

10. A serial printer comprising a support structure, a platen on said support structure, a printing head means carried on said support structure and movable between a guide position and a displaced position, said printing head means being reciprocated on said support structure to effect printing when said printing head means is in said guide position, and a movable guide means movably mounted on said support structure between an operable position and a displaced position, said movable guide means reciprocably supporting and guiding said printing head means to effect printing when said movable guide means is in said operable position, said printing head means being movable to its displaced position when said movable guide means is in its displaced position, said support structure comprising an openable cover means movable between open and closed position, said movable guide means comprising linkage means operably connected to said cover means such that movement of said cover means between its closed and open position effects movement of said movable guide means between its operable and displaced positions.

11. A serial printer comprising a support structure, a platen on said support structure, a printing head means carried on said support structure and movable between a guide position and a displaced position, said printing head means being reciprocated on said support structure to effect printing when said printing head means is in said guide position, and a movable guide means movably mounted on said support structure between an operable position and a displaced position, said movable guide means reciprocably supporting and guiding said printing head means to effect printing when said movable guide means is in said operable position, said printing head means being movable to its displaced position when said movable guide means is in its displaced position, said movable guide means comprising an arm pivotably mounted on said support structure, said arm carrying an engageable means engageable with said printing head means when said movable guide means is in its operable position, said movable guide means further comprising biasing means biasing said arm in a direction in which said engageable means tends to disengage from said printing head means.

12. A serial printer comprising a support structure, a platen on said support structure, a printing head means carried on said support structure and movable between a guide position and a displaced position, said printing head means being reciprocated on said support structure to effect printing when said printing head means is in said guide position, and a movable guide means movably mounted on said support structure between an operable position and a displaced position, said movable guide means reciprocably supporting and guiding said printing head means to effect printing when said movable guide means is in said operable position, said printing head means being movable to its displaced position when said movable guide means is in its displaced position, said support structure comprising an openable cover means movable between open and closed positions, said movable guide means comprising linkage means operably connected to said cover means such that movement of said cover means between its closed and open position effects movement of said movable guide means between its operable and displaced positions, said linkage means comprising at least one link arm pivotably connected to said cover means and another link arm carrying an engageable member engageable with said printing head means when said cover means is in its closed position and disengageable from said printing head means when said cover means is in its open position, said linkage means further comprising pivot means pivotably connecting said one and said other link arms.

13. A serial printer comprising a support structure, a platen on said support structure, a printing head means carried on said support structure and movable between a guide position and a displaced position, said printing head means being reciprocated on said support structure to effect printing when said printing head means is in said guide position, and a movable guide means movably mounted on said support structure between an operable position and a displaced position, said movable guide means reciprocably supporting and guiding said printing head means to effect printing when said movable guide means is in said operable position, said printing head means being movable to its displaced position when said movable guide means is in its displaced position, said movable guide means comprising an arm pivotably mounted on said support structure, said arm carrying an engageable means engageable with said printing head means when said movable guide means is in its operable position, said movable guide means further comprising biasing means biasing said arm in a direction in which said engageable means tends to disengage from said printing head means, said support structure comprising a movable cover means movable between open and closed position, said cover means retaining said arm in a position such that said engageable means engages said printing head means when said cover means is in its closed position, said biasing means biasingly moving said arm to disengage said engageable means from said printing head means when said cover means is moved from its closed to its open position.

14. A serial printer comprising:

a printer casing;

a pair of elongated guide members extending longitudinally in said printer casing;

an elongated platen;

a carrier carrying a printing head reciprocably mounted on said guide members;

first engageable means on said carrier slidably engaging one of said guide members such that said carrier is reciprocably slidable on said one guide member during printing;

second engageably means on said carrier engaging the other of said guide members such that said carrier is reciprocably slidable on said other guide member during printing, said second engageable means being operable to be disengaged from said other guide member;

movable support means on said casing supporting said other guide member for movement between an operable position where said other guide member reciprocably supports said carrier during printing and a displaced position wherein said other guide member is disengaged and displaced from said second engageable means;

said one guide member having a longitudinal axis, said first engageable means rotatably supporting said carrier to provide for rotation of said carrier about said longitudinal axis of said one guide member when said movable support means is moved to its displaced position;

said printer casing comprising a printer frame formed with a U-shaped positioning groove for precisely positioning said other guide member with respect to said printer frame when said other guide member is received in said positioning groove.

15. A serial printer comprising:

a printer casing;

a pair of elongated guide members extending longitudinally in said printer casing;

an elongated platen;

a carrier carrying a printing head reciprocably mounted on said guide members;

first engageable means on said carrier slidably engaging one of said guide members such that said carrier is reciprocably slidable on said one guide member during printing;

second engageably means on said carrier engaging the other of said guide members such that said carrier is reciprocably slidable on said other guide member during printing, said second engageable means being operable to be disengaged from said other guide member;

movable support means on said casing supporting said other guide member for movement between an operable position where said other guide member reciprocably supports said carrier during printing and a displaced position wherein said other guide member is disengaged and displaced from said second engageable means;

said one guide member having a longitudinal axis, said first engageable means rotatably supporting said carrier to provide for rotation of said carrier about said longitudinal axis of said one guide member when said movable support means is moved to its displaced position;

said printer casing including a printer cover, said movable support means being mounted on said printer cover.

16. A serial printer comprising:

a printer casing;

a pair of elongated guide members extending longitudinally in said printer casing;

an elongated platen;

a carrier carrying a printing head reciprocably mounted on said guide members;

first engageable means on said carrier slidably engaging one of said guide members such that said carrier is reciprocably slidable on said one guide member during printing;

second engageably means on said carrier engaging the other of said guide members such that said carrier is reciprocably slidable on said other guide member during printing, said second engageable means being operable to be disengaged from said other guide member;

movable support means on said casing supporting said other guide member for movement between an operable position where said other guide member reciprocably supports said carrier during printing and a displaced position wherein said other guide member is disengaged and displaced from said second engageable means;

said one guide member having a longitudinal axis, said first engageable means rotatably supporting said carrier to provide for rotation of said carrier about said longitudinal axis of said one guide member when said movable support means is moved to its displaced position;

said printer casing comprising a printer frame, said movable support means being swingably supported on said printer frame, said printer frame having a positioning groove for coming into engagement with said other guide member when said other guide member is moved into said operable position, and out of engagement with said other guide member when said other guide member is moved to said displaced position.

17. A serial printer comprising:

a printer casing;

a pair of elongated guide members extending longitudinally in said printer casing;

an elongated platen;

a carrier carrying a printing head reciprocably mounted on said guide members;

first engageable means on said carrier slidably engaging one of said guide members such that said carrier is reciprocably slidable on said one guide member during printing;

second engageably means on said carrier engaging the other of said guide members such that said carrier is reciprocably slidable on said other guide member during printing, said second engageable means being operable to be disengaged from said other guide member;

movable support means on said casing supporting said other guide member for movement between an operable position where said other guide member reciprocably supports said carrier during printing and a displaced position wherein said other guide member is disengaged and displaced from said second engageable means;

said one guide member having a longitudinal axis, said first engageable means rotatably supporting said carrier to provide for rotation of said carrier about said longitudinal axis of said one guide member when said movable support means is moved to its displaced position;

said movable support means comprising an openable cover attached to said printer casing and links interposed between said openable cover and said other guide member.

18. A serial printer comprising:

a printer casing;

a pair of elongated guide members extending longitudinally in said printer casing;

an elongated platen;

a carrier carrying a printing head reciprocably mounted on said guide members;

first engageable means on said carrier slidably engaging one of said guide members such that said carrier is reciprocably slidable on said one guide member during printing;

second engageably means on said carrier engaging the other of said guide members such that said carrier is reciprocably slidable on said other guide member during printing, said second engageable means being operable to be disengaged from said other guide member;

movable support means on said casing supporting said other guide member for movement between an operable position where said other guide member reciprocably supports said carrier during printing and a displaced position wherein said other guide member is disengaged and displaced from said second engageable means;

said one guide member having a longitudinal axis, said first engageable means rotatably supporting said carrier to provide for rotation of said carrier about said longitudinal axis of said one guide member when said movable support means is moved to its displaced position;

said printer casing having a pivotal cover pivotal to an open position to provide access to the inside of said printer casing, said movable support means which supports said other guide member being disposed on said cover.

19. A serial printer comprising:

a printer casing;

a pair of elongated guide members extending longitudinally in said printer casing;

an elongated platen;

a carrier carrying a printing head reciprocably mounted on said guide members;

first engageable means on said carrier slidably engaging one of said guide members such that said carrier is reciprocably slidable on said one guide member during printing;

second engageably means on said carrier engaging the other of said guide members such that said carrier is reciprocably slidable on said other guide member during printing, said second engageable means being operable to be disengaged from said other guide member;

movable support means on said casing supporting said other guide member for movement between an operable position where said other guide member reciprocably supports said carrier during printing and a displaced position wherein said other guide member is disengaged and displaced from said second engageable means;

said one guide member having a longitudinal axis, said first engageable means rotatably supporting said carrier to provide for rotation of said carrier about said longitudinal axis of said one guide member when said movable support means is moved to its displaced position;

said printer casing having a downstream end defined by a pivotal cover, said pivotal cover defining said movable support means which supports said other guide member.

* * * * *